US008512146B2

(12) United States Patent
Gururajan et al.

(10) Patent No.: US 8,512,146 B2
(45) Date of Patent: Aug. 20, 2013

(54) CASINO TABLE GAME YIELD MANAGEMENT SYSTEM

(75) Inventors: Prem Gururajan, Kitchener (CA); Maulin Gandhi, Kitchener (CA); Patrick Hermann Denis, Kitchener (CA); Jason Robert Jackson, Hamilton (CA); Christopher Taylor, Elmira (CA)

(73) Assignee: Tangam Technologies Inc., Waterloo, Ontario (CA)

( * ) Notice: Subject to any disclaimer, the term of this patent is extended or adjusted under 35 U.S.C. 154(b) by 358 days.

(21) Appl. No.: 12/619,671

(22) Filed: Nov. 16, 2009

(65) Prior Publication Data

US 2011/0118007 A1 May 19, 2011

(51) Int. Cl.
*A63F 9/24* (2006.01)

(52) U.S. Cl.
USPC ..... 463/42; 463/22; 463/23

(58) Field of Classification Search
None
See application file for complete search history.

(56) References Cited

U.S. PATENT DOCUMENTS

| | | | | |
|---|---|---|---|---|
| 6,446,864 | B1 * | 9/2002 | Kim et al. | 235/382 |
| 6,993,494 | B1 * | 1/2006 | Boushy et al. | 705/7.31 |
| 7,212,978 | B2 | 5/2007 | Kowal et al. | |
| 7,404,765 | B2 * | 7/2008 | Soltys et al. | 463/25 |
| 8,216,056 | B2 * | 7/2012 | Lutnick et al. | 463/22 |
| 2003/0003997 | A1 * | 1/2003 | Vuong et al. | 463/42 |
| 2003/0073471 | A1 * | 4/2003 | Varley | 463/1 |
| 2005/0051965 | A1 * | 3/2005 | Gururajan | 273/292 |
| 2005/0153760 | A1 * | 7/2005 | Varley | 463/1 |
| 2006/0019750 | A1 * | 1/2006 | Beatty | 463/42 |
| 2006/0084502 | A1 * | 4/2006 | Downs et al. | 463/29 |
| 2006/0217199 | A1 * | 9/2006 | Adcox et al. | 463/40 |
| 2006/0281544 | A1 * | 12/2006 | Frattinger et al. | 463/29 |
| 2006/0287098 | A1 * | 12/2006 | Morrow et al. | 463/42 |
| 2006/0287103 | A1 * | 12/2006 | Crawford et al. | 463/42 |
| 2007/0045957 | A1 * | 3/2007 | Blair, Jr. | 273/274 |
| 2007/0060365 | A1 * | 3/2007 | Tien et al. | 463/42 |
| 2007/0077995 | A1 * | 4/2007 | Oak et al. | 463/42 |
| 2007/0111799 | A1 * | 5/2007 | Robb et al. | 463/42 |
| 2007/0117604 | A1 * | 5/2007 | Hill | 463/16 |
| 2007/0155490 | A1 * | 7/2007 | Phillips et al. | 463/29 |
| 2007/0265064 | A1 * | 11/2007 | Kessman et al. | 463/25 |
| 2008/0015030 | A1 * | 1/2008 | Baazov et al. | 463/42 |
| 2008/0102957 | A1 * | 5/2008 | Burman et al. | 463/42 |
| 2008/0113772 | A1 * | 5/2008 | Burrill et al. | 463/25 |
| 2008/0138773 | A1 * | 6/2008 | Lathrop | 434/72 |
| 2008/0146326 | A1 * | 6/2008 | Morrow et al. | 463/26 |
| 2008/0153600 | A1 * | 6/2008 | Swarna | 463/43 |
| 2008/0161101 | A1 * | 7/2008 | Lutnick et al. | 463/25 |
| 2008/0220836 | A1 * | 9/2008 | Nagano | 463/12 |

(Continued)

OTHER PUBLICATIONS

Table-games revenue management: applying survival analysis. (Casino Management), by Clayton Peister, Feb. 2007, Cornell Hotel & Restaurant Administration Quarterly.

(Continued)

*Primary Examiner* — Paul A D'Agostino
(74) *Attorney, Agent, or Firm* — Anglehart et al.

(57) ABSTRACT

The casino table yield management data processing system has a minimum bet change recommendation generator receiving casino table occupancy and player betting data and generating recommendation data based on casino game operations model data and business rule data. A timing filter determines when recommendation data is to be presented to an operator. A quantification filter calculates revenue value data of implementing a minimum bet change and determining whether recommendation data is to be presented to an operator.

18 Claims, 6 Drawing Sheets

(56) References Cited

U.S. PATENT DOCUMENTS

| | | | | |
|---|---|---|---|---|
| 2008/0261699 | A1* | 10/2008 | Topham et al. | 463/42 |
| 2008/0281666 | A1* | 11/2008 | Kessman et al. | 705/9 |
| 2009/0024456 | A1* | 1/2009 | Risnoveanu et al. | 705/11 |
| 2009/0054139 | A1* | 2/2009 | Anderson | 463/31 |
| 2009/0069090 | A1* | 3/2009 | Moser et al. | 463/42 |
| 2009/0098932 | A1* | 4/2009 | Longway | 463/22 |
| 2009/0124376 | A1* | 5/2009 | Kelly et al. | 463/29 |
| 2009/0131151 | A1* | 5/2009 | Harris et al. | 463/22 |
| 2009/0131152 | A1* | 5/2009 | Busse | 463/23 |
| 2009/0239667 | A1* | 9/2009 | Rowe et al. | 463/42 |
| 2009/0275399 | A1* | 11/2009 | Kelly et al. | 463/27 |
| 2009/0280907 | A1* | 11/2009 | Larsen et al. | 463/42 |
| 2010/0056271 | A1* | 3/2010 | Stasi et al. | 463/30 |
| 2010/0248843 | A1* | 9/2010 | Karsten | 463/43 |
| 2011/0014964 | A1* | 1/2011 | Crowder et al. | 463/13 |

OTHER PUBLICATIONS

Table Games: Optimal Utilization, by Andrew McDonald,Tue, Aug. 12, 2008.

* cited by examiner

Pit Dashboard Wednesday, July 01, 2009. 14:20 JAMES DEAN (JAD) Logout Options

| | Current | Last Month | Target |
|---|---|---|---|
| DATA FRESHNESS | **Needs Impr (0.5)** | Good (0.75) | Good (0.70) |
| DATA VALIDATIONS | n/a | 65% | 75% |

RECOMMENDATIONS

14:15 - Occupancy for $15 players on BJ games is too high and has been for at least 45 minutes. Convert 1 BJ Games tables to $10 min bet. Options: BJC108 or BJC110. OPEN - <click>

11:05 - 11:50 - BJ6D 109 - $25 min bet table has at least one player betting at more than $50 per hand. Raise the min bet of BJ6D 111 to $50 to offer exclusivity. EXPIRED <click>

10:00 - 10:40 - BJC 112 - $25 min bet table has at least one player betting at more than $50 per hand. Raise the min bet of BJ6D 111 to $50 to offer exclusivity. ACCEPTED AS IS <click>

CURRENT MAIN FLOOR OCCUPANCY

BJ Games (BJ6D, BJC, DD)

| Min Bet | Occupancy | Tables | Players | Empty Seats |
|---|---|---|---|---|
| $5 | - | 0 | 0 | 0 |
| $10 | - | 0 | 0 | 0 |
| $15 | **Peak (5)** | 3 | 18 | 1 |
| $25 | Optimal (3) | 10 | 30 | 28 |
| $50 | **Peak (4)** | 3 | 12 | 6 |
| $100+ | Optimal (1.5) | 3 | 4 | 11 |

SP Games (SP21)

| Min Bet | Occupancy | Tables | Players | Empty Seats |
|---|---|---|---|---|
| $5 | - | 0 | 0 | 0 |
| $10 | - | 0 | 0 | 0 |
| $15 | **Peak (5)** | 3 | 18 | 1 |
| $25 | Optimal (3) | 10 | 30 | 28 |
| $50 | **Peak (4)** | 3 | 12 | 6 |
| $100+ | Optimal (1.5) | 3 | 4 | 11 |

JAMES DEAN MANAGED TABLES

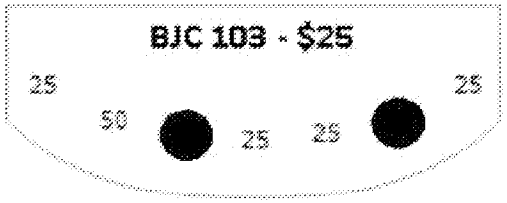

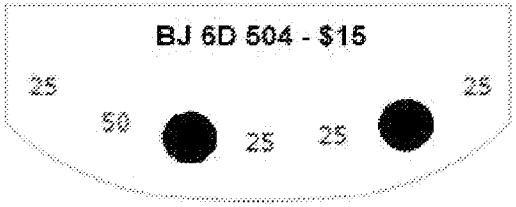

FIGURE 5

Date 7/1/2009
UPDATE

| Unrealized Revenue | Amount |
|---|---|
| HV player interruptions | $350 |
| Occupancy issues | $200 |
| Other | |
| **Total** | **$550** |

| Data Validations | Number | % pass |
|---|---|---|
| Actual | 28 | 70% |

| CSMs on Duty |
|---|
| John Smith |
| Jordy Palanski |
| Jim Smiton |

| Recomendations | Number | Accept % | Response % |
|---|---|---|---|
| Protect HV players | 16 | 50% | 75% |
| Occupancy mgmt | 10 | 70% | 80% |
| Business rules | 3 | 100% | 100% |
| Notifications | 4 | 50% | 60% |
| Other | 1 | 100% | 100% |
| **Total** | **34** | **56%** | **80%** |

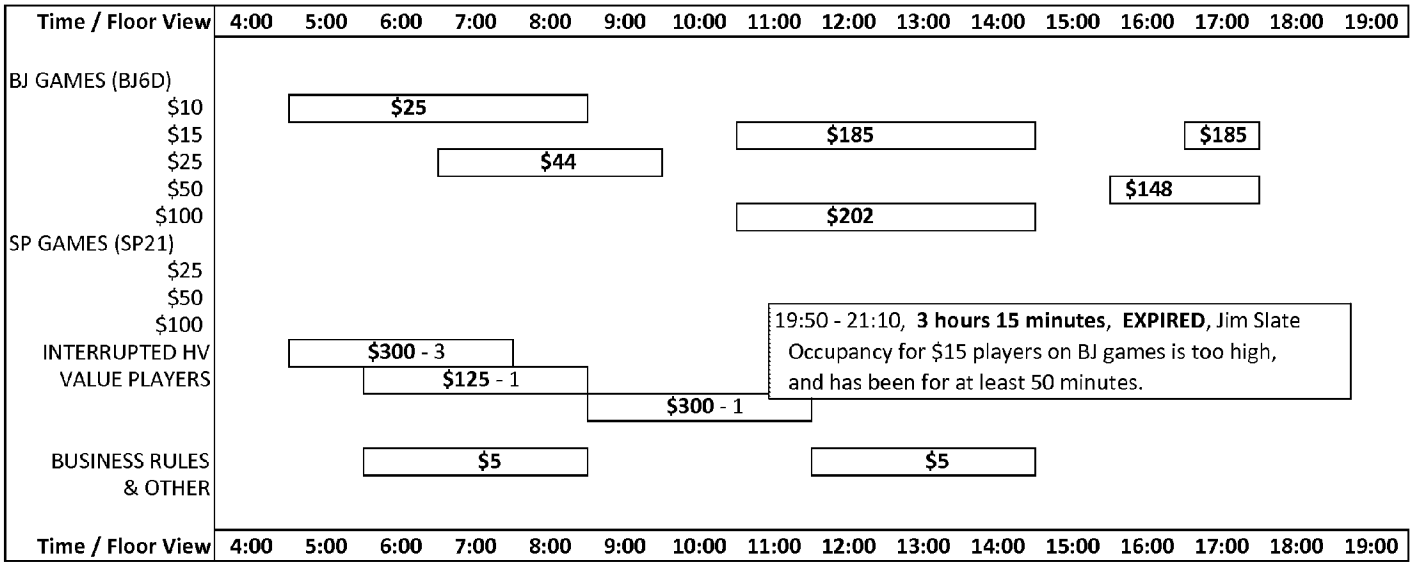

| OPTIONS | | |
|---|---|---|
| | Occupancy issue at least 40 minutes | X |
| | HV Player plays at least 20 minutes | X |

DATA COLLECTION INTEGRITY
11am - 6pm: Jane Bondy, Conner Jenkins, Jim Slate, Sifison Baloney
6pm - 3am: Jane Bondy, Conner Jenkins, Jim Slate, Sifison Baloney
3am - 11am: Jane Bondy, Conner Jenkins, Jim Slate, Sifison Baloney

FIGURE 6

CASINO TABLE GAME YIELD MANAGEMENT SYSTEM

TECHNICAL FIELD

The present invention relates to yield management data processing systems and casino table game management.

BACKGROUND

Yield management (also known as "revenue management") systems are used for determining the most profitable price for products and services in response to market demands. Hotel room pricing, airline tickets and car rentals are but some examples of industries that use yield management data processing systems.

In general, the conditions that a service or product should meet for yield management to be applicable are (1) that there is a fixed amount of resources available for sale, (2) that there is a time limit to selling the resources, after which they cease to be of value, and (3) that different customers are willing to pay a different price for using the same amount of resources.

In the context of a casino in which gaming tables are operated, it has been suggested that yield management can be applied, see "Table games revenue management: applying survival analysis" by Clayton Peister published in Cornell Hotel and Administration Quarterly, February 2007, and "Table Games: Optimal Utilization", by Andrew MacDonald and Bill Eadington, published in Global Gaming Business, volume 7, number 8, August, 2008.

These articles teach that occupancy of gaming tables affects the number of plays per hour, namely that more players at a table reduces the number of rounds per hour. While the number of bets made per hour can still be greater at a full table than a table that is half full, revenue can be adversely affected when players betting smaller amounts play at a table with players betting larger amounts. These articles teach that yield management analysis can be used to gain insight into more profitable or optimal utilization of table game resources in a casino. No disclosure of a yield management data processing system adapted for use in a casino is provided.

SUMMARY

It has been discovered that managers of casino table game rooms or pits need to balance a variety of player and house considerations when deciding on implementing a gaming table betting minimum change, and thus that gaming table betting minimum change recommendations based on yield management principles are advantageously filtered to respect pre-established house rules defining for example betting minimums, and minimum numbers of tables operated at such betting minimums, and target occupancy levels for each betting level.

It has been discovered that gaming table betting minimum change recommendations are advantageously filtered to reduce either the frequency or number of changes implemented, or to avoid changes made in response to short-lived conditions.

It has been discovered that it is advantageous to calculate a financial value associated with gaming table betting minimum change recommendations to only display recommendations that are above a certain value threshold, or to help managers of casino table games decide on implementing a gaming table betting minimum change, or to help managers of casino table games evaluate the financial impact of recommendations that were not implemented.

BRIEF DESCRIPTION OF THE DRAWINGS

The invention will be better understood by way of the following detailed description of embodiments of the invention with reference to the appended drawings, in which:

FIG. 5 is a screen shot from the recommendation display module according to one embodiment; and FIG. 6 is a screen shot from the historical log module according to one embodiment.

DETAILED DESCRIPTION

Figure 1:
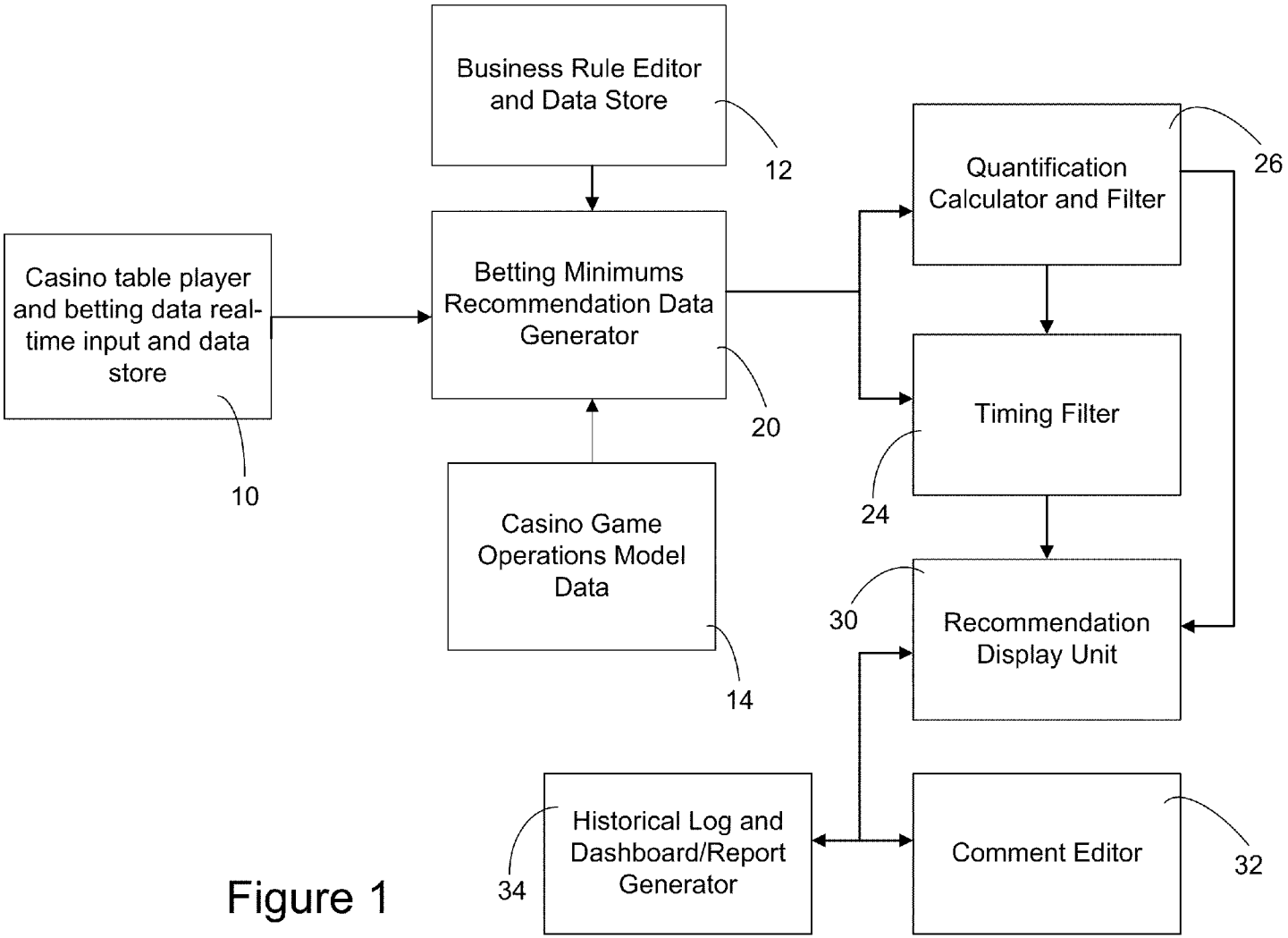
FIG. 1 is a schematic system block diagram of a yield management data processing system according to one embodiment of the invention.
Figure 2:
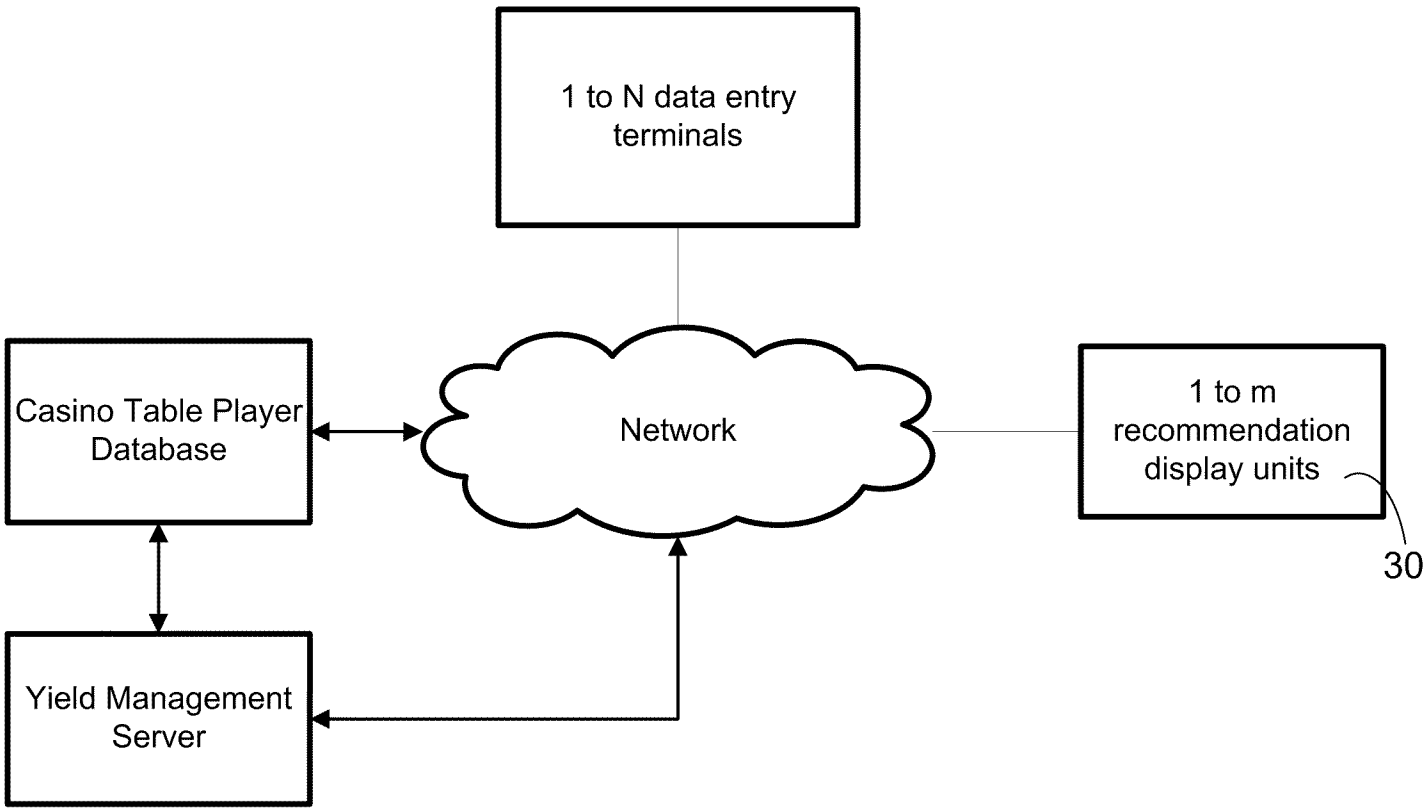
FIG. 2 is a network diagram of the yield management data processing system of FIG. 1.

In the following description of embodiments of the invention, reference is made to diagrams that are certain abstractions of the software and hardware system that combine to form the embodiments. These abstractions are to be understood as such, and are presented here to help understand the embodiment and enable their reproduction or implementation. In FIG. 1, the division of the system into blocks is in accordance with functions of the system and is presented as such with the understanding that in an implementation, one need not have software or hardware component that are logically or physically divided in such a manner. Likewise, the physical equipment installation illustrated in FIG. 2 illustrating one particular client-server architecture is but one possibility, since the functions of the system can be distributed differently without departing from the invention. For convenience, the system and specific examples are explained in the context of the game of Blackjack. It is understood that some or all of the components of the system can be applied to other table games as well.

The casino table player and betting data real-time input and data store module 10 as illustrated in FIG. 1 is responsible for capturing and storing all of the information necessary to effectively produce recommendations for a casino game floor and improve the yield management. This information includes the set of current open tables and the players on these tables with their wagers. For recommendations to be most effective, this input should be provided to the system in real-time; otherwise no current action may be applicable to improve yield management. A user enters the information and this information is then stored for retrieval purposes.

Multiple components can be used to capture the casino table player and his wager information. For example, as illustrated in FIG. 2, there is a network where information can travel, a database to store the casino table player information indexed by time the events occurred, a yield management server to process the incoming information and generate recommendations and a system such as a tablet PC or a casino player rating software that can broadcast this information over the network to the database.

Data entry can happen from multiple machines at once. A data entry terminal can be any machine, such as Tablet PC or an existing casino player rating system which can run an interface to collect the necessary information and send this data through a network to a yield management server to process the information and store it in a casino table player database. Alternatively, it could be possible to send this data directly to a casino table player database and the yield management server would retrieve this raw data. Alternatively, data could be collected by automated data collection technologies such as RFID embedded casino chips or video analytics and this data could be made available to the yield management server.

The real-time information that is provided can be sent to the database every time the casino state changes or based on a pre-defined time interval. On such events, recommendations can be produced through the yield management server and sent to the recommendation display units 32.

The user interacts with the component 10 entering the table current minimum bet and the set of players and their wagers and the positions that they are playing. A user can also add additional information such as the money a player has exchanged for betting chips. Interface 10 can be the same interface that the user has been using for a player rating system or from any manual data entry user interface or automated data collection device that can collect such information. If data entry is manual, it is expected that user updates every data point that he is managing preferably at least every 15 minutes.

The real-time information provided by manual user entry might on occasion be incorrect. The yield management server is responsible to identify such potentially erroneous data points which are then stored into the casino table player database for logging purposes. Other options are available such as ignoring invalid information altogether or provide no error-proofing for which the betting minimums recommendation data generator would have to account for.

Users who are manually entering the real-time information can be provided two feedback mechanisms to indicate the status of their performance. The first is a data freshness score which represents how often a user updates the casino real-time information and the second, a data validation score which represents the accuracy of their information. The data freshness score can be measured by analyzing the frequency of the data points that have been updated. The data validation score can be measured by comparing the information that a different user (e.g., a co-worker or peer or manager) has independently recorded to the information that the current user has indicated for the same table at specific points in time.

Module 12 shown in FIG. 1 will now be described. The business rules are the data that contains information regarding how the gaming floor will be managed by the yield management system. The business rules can function by storing the information in a file for easy access, and modifications by a user. Any basic text editor can be sufficient to access, edit and save the pertinent data. This file or data can be saved in a database indexed on the period of time that this information was applicable for. This allows a historical review of the casino state for any relevant time period.

The Business rule data is accessed on demand by the user or the system, to review, modify or access its content. Once created or modified, the casino game operations model can be loaded automatically when the system is reset or initialized, or can be manually uploaded to override the current information.

The following information will describe sample information that a user can provide for the business rules. This is not a complete list but highlights some important data points.

A user can provide the grandfathering policy of the casino. Grandfathering policy reflects the fact that if the table limit will be raised, any current players may continue playing at the original table minimum bet, instead of the new table minimum bet, while new players must wager according to the new table minimum. Also the user provides information on how the casino will be receiving recommendations based on pit groups and game type groups using geographical and management considerations. For example, a high limit pit may be treated separate than the main floor. The lowest minimum bet and highest minimum bet (and related maximum bets) for each table must be specified, but can also be specified at a pit level for a specific period of time. As an example, the user can specify that Blackjack table # 18 can only have betting minimums ranging from $25 to $100.

The user can specify the minimum or maximum number of tables at specific minimum bet levels based on a pit group, across one or more game types and one or more table minimum applicable for a period of time. For example, the user can specify that there needs to be at least two Blackjack games at $25 minimum bet on the main floor during evening shifts on Friday and Saturday.

The user can specify the target occupancy levels for each betting minimum tier. This is the desired average number of players seated on a table game at a specific betting minimum, and can be categorized into four occupancy groups—low, optimal, high and peak occupancy. The target occupancy numbers for each category low, optimal, high and peak are specified in the business rules and are used to determine which category a set of table games and betting minimum fall under. For example, if for $25 blackjack games, the occupancies for low, optimal and high are set to 2, 3 and 4 respectively, then if the average occupancy for $25 Blackjack games falls below 2 players per table, the games are considered to be in low occupancy. If the average occupancy is between 2 and 3 players per table, the games are considered to be in optimal occupancy. If the average occupancy is between 3 and 4 players per table, the games are considered to be in high occupancy, and above 4 players per table, the games are considered to be in peak occupancy. The target occupancy numbers can be set to different levels for different times of the day, and different betting minimums. For example, a low occupancy on a $5 minimum bet table can be set to 4 players for every day of the week, whereas the low occupancy on a $100 minimum table can be set to 2 players on Fridays and Saturdays and 1 player for the rest of the week.

The user can also specify the aggressiveness level to generate recommendations that control the occupancy levels at a specific betting minimum. The aggressiveness level determines at what point a recommendation should be triggered to convert tables to the specific betting minimum and lower the average occupancy for that betting minimum. For example, the aggressiveness levels can be set to conservative, moderate or aggressive. If the aggressiveness level is set to conservative, then a recommendation will be generated when the average occupancies of a set of table games at a specific betting minimum is at peak occupancy, to lower the average occupancies to high occupancy. If the aggressiveness level is set to moderate, then a recommendation will be generated when the average occupancies of a set of table games at a specific betting minimum is at high occupancy, to lower the average occupancy to optimal occupancy. The aggressiveness level can be set for a specific period of time, and can be set to different levels for different time of the day or days of the week.

The user also specifies another set of thresholds that determine the minimum projected financial value for a recommendation and/or the amount of time that a situation has persisted before a recommendation should be produced. As an example, the user may specify that an occupancy situation must persist for at least 15 minutes out of the most recent 20 minutes before a recommendation is produced to resolve the situation.

Note that some of data points discussed above allows the user to ensure that new recommendations provided by the system do not violate their management policies, but also allows new recommendations to ensure that their betting minimums abides by their business rules. Other data points ensure that a certain level of quality can be expected by new recommendations produced by the system, ensuring that each recommendation should be treated with high priority.

The casino game operations model data 14 is a file store that contains the representation of the casino floor and the data relevant to the efficiency in operating these resources. The casino game operations data functions by storing the information in a content centered manner for easy access, and modifications by a user. Any basic text editor is sufficient to access, edit and save the pertinent data. This file or data can be saved in a database indexed on the period of time that this information was applicable for. This allows a historical review of the casino state for any valid time period.

The casino game operations model data 14 is accessed on demand by the user or the system, to review, modify or access its content. Once created or modified, the casino game operations model can be loaded automatically (or otherwise accessed) when the system is reset or initialized, or can be manually uploaded to override the current information.

Information that a user needs to provide for the casino game operations are the list of tables that will be managed by the yield management system, the number of spots available on each table, the game type of each table and the location of the table relative to a casino pit.

In relation to a game type, the user also provides the house edge, indexed by player skill level at the different table minimum bets and the expected average rounds per hour the table will be able to complete based on the table occupancy. The house edge is the percentage of the player's original bet the casino can expect to win theoretically or mathematically based on the skill level of the player. For example, the casino would generally have a greater house edge over $5 players than most $100 players since a typical $100 player is often more experienced and makes fewer mistakes in game play.

This information is used in calculating theoretical win. Theoretical win is the amount that casino can expect from a set of players on a table for a period of time based on the player(s) skill level and is defined as:

$$\sum_{i}^{n} W_i * RPH_{g,n} * H_b * T_i$$

where n is the total number of occupied positions at the table, $W_i$ is the wager at position i, g is the game type of the table, b is a table betting limit that a player is associated to, $RPH_{g,n}$ is the number of rounds per hour that a player on a table of game type g at occupancy n will experience, $H_b$ is the house edge of the table for a player at betting level b and $T_i$ is the duration that the player at position i played for or is projected to play for.

By way of example, the following table shows the average rounds per hour at a 6 deck Blackjack game at each occupancy level.

| 1 | 2 | 3 | 4 | 5 | 6 | 7 |
|---|---|---|---|---|---|---|
| 209 | 136 | 99 | 79 | 66 | 57 | 50 |

The purpose of the betting minimums recommendation data generator 20 is to create recommendations which improve the revenue and customer occupancy experience for a casino. A recommendation is a suggestion that may result in changing one or more casino table games minimum bet based on a particular situation identified. A recommendation can be broadly categorized into three types: high value player recommendation, occupancy management recommendation and business rules recommendation. Based on the type of recommendation, the scope of what it can affect can be a single table up or a set of tables.

In the embodiment illustrated, the generator 20 receives the business rule data, and a recommendation is not produced if in any way that it conflicts with the business rules that are currently in effect. For example, a recommendation to raise the table minimum bet to $500 will not be generated if that particular table does not allow the minimum bet to go over $50.

To produce a high value player recommendation, we must first define what a high value player (HVP) is. A HVP can be a casino table player whose current betting wager is considered to be significantly above that of the current table minimum bet. Individual thresholds can be set for each table minimum bet to determine a HVP. For example, on a $25 minimum bet table, a player betting $100 or above can be a HVP. Alternatively, a HVP can be a player that has a buy-in amount above a specified threshold (defined in the business rules) and the time of the buy-in amount is within a certain period of time relative to the current time (also defined in the business rules).

A HVP recommendation is a suggestion to raise the betting minimum on the table that the HVP is seated, in order to protect the HVP. A HVP is considered protected because raising the table limit will prevent new players that would otherwise wager at the previous and lower table minimum bet from joining this table and potentially reducing the theoretical win for the table (and thus for the casino), and potentially interrupt the game experience for the HVP. A majority of HVP tend to appreciate such exclusivity or protection, and failing to raise the limit on the table with HVP may deteriorate the players experience at the casino and opinion of the casino affecting a player's duration of play or decision to return to the casino. Generating HVP recommendation is the process of identifying such situations, which can be applied to all casino tables. The following is an example of a HVP recommendation:

"BJ 24—$15 minimum bet table has at least one player betting at more than $50 per hand. Raise the minimum bet of BJ 24 to $50 to offer exclusivity to the high value player."

Occupancy management recommendations are generated when the overall occupancy of a particular betting minimum is lower or higher than the occupancy levels defined by the aggressiveness level set by the casino in the business rules. The target occupancy is defined as the occupancy level corresponding to given aggressiveness level. For example, if the aggressiveness level is conservative, then the target occupancy is set to the high occupancy level. If the overall occupancy of a betting minimum is higher than this target level, a recommendation is generated to convert tables to bring the overall occupancy for that betting minimum to the target occupancy. For example, if the aggressiveness level for Blackjack games is set to moderate, then the target occupancy for the $25 betting minimum will be set to the optimal level. If the overall occupancy for $25 Blackjack games goes to high or peak occupancy, then a recommendation will be generated to convert some tables to the $25 minimum bet to lower the overall occupancy for $25 Blackjack games to the optimal level. To determine which tables to convert to the new minimum bet requires intelligence. For example, higher betting minimum can be given priority over lower betting minimums. In the previous example, if the $50 Blackjack games are at optimal occupancy, then the suggestion will not be made to convert a $50 Blackjack game to $25. However, the occupancy on lower betting tiers can be compromised. In the previous example, even if the $15 betting tier is at peak, a recommendation to convert a $15 Blackjack table to $25 will still be made in order to give priority to the $25 betting tier.

Occupancy management recommendations can also be made when lower betting minimums have no tables, and the higher betting minimums are at low occupancy levels. This type of recommendation is generated to create demand for the lower betting minimum during less busy periods on the casino floor. When there are no tables at the $10 tier for blackjack games but there are numerous tables at the $25 tier, many of which are not occupied, is an example of this situation.

Occupancy management recommendations can also be made to lower the overall occupancy of a betting minimum tier, if the other betting minimum tiers are in low occupancy. For example, if the target occupancy for $5 Blackjack games is high occupancy, and at the current time, the $5 Blackjack games are experiencing high occupancy while the $10 and $15 Blackjack games are experiencing low occupancy, then a recommendation will be generated to convert some tables to the $5 minimum bet. In this situation, we didn't wait for the $5 blackjack games to go into peak occupancy before converting some tables to $5 minimum bet.

Generating occupancy management recommendations is the process of identifying such situations at the various betting tiers and determining when or if betting minimums can be adjusted to resolve the situation. An occupancy based recommendation will suggest the number of tables that is necessary to convert to the betting tier with occupancy problems and may also suggest the most appropriate tables for this purpose. The tables that are suggested could be selected from a wide range of criteria, such as for example the number of players seated at the table, the betting minimum of that table, the occupancy level of the table's betting minimum and the proximity of the table to other tables of similar betting limits in the casino. The concept of using proximity as a criteria is especially useful when it is used to determine where there are other tables or players at similar betting limits. The following is an example of an occupancy management recommendation:

"Occupancy for $25 players on the BJ games is too high and has been for at least 1 hour and 12 minutes. Convert 1 BJ game table to $25 minimum bet. Suggested Options: BJ 3 or BJ 5"

Another type of recommendation concerns meeting the table spread constraints from the business rules. The table spread rules represent the minimum or maximum number of tables for a set of table minimum bets and game types at certain time periods. A business rule recommendation is a suggestion to convert the required number of tables to meet the minimum number of tables defined by the table spread rules and may also suggest the most appropriate tables for this purpose. Generating business rules recommendations is the process of identifying such situations and determining betting minimums adjustments, on specific tables, to resolve the situation. The following is an example of a business rule recommendation:

"There is only 1 BJ game at $10 minimum bet. The business rule requires at least 2 BJ games at $10 minimum bet for this shift. Convert 1 BJ game to $5. Suggested Option: BJ 19"

The betting minimums recommendation data generator 20 can also merge recommendations generated from different recommendation categories, to reduce the number of recommendations and ensure a higher level of quality. For example, a HVP recommendation on BJ 5 to raise the betting limit from $10 to $50, can be merged with an occupancy management recommendation requiring 1 extra table for Blackjack games on the $50 betting minimum limit tier if both are generated at the same time. Instead of sending out both recommendations, the betting minimums recommendation data generator 20 will only output one recommendation, for example the HVP recommendation in this situation. This improves the quality of recommendations as the same recommendation in the previous example can resolve a HVP situation and an occupancy management situation.

While in FIG. 1, betting minimums recommendation data generator 20 acts directly on data from modules 10, 12 and 14, it will be appreciated that the historical log and dashboard/report generator module 34 can also be used to in addition to the other modules to generate betting minimums recommendations. An example of historical information that can be used is the status information on previously generated recommendations. The status information can contain whether the recommendation was accepted or rejected, and if rejected, the reason for rejection. This status information can be used to determine whether to regenerate the same, or similar recommendation at the current point in time. For example, if a recommendation generated five minutes ago to raise the betting minimum on BJ 5 from $5 to $50 to protect a HVP was rejected since the situation did not exist anymore due to stale data, a new recommendation to protect the HVP on BJ5 for the same set of wagers will not be re-regenerated as it is likely to be rejected again by the user.

To generate recommendations requires the data samples representing the casino table players and betting data for the complete casino for the same time period. The business rules are also required, to not only generate business rules recommendation, but also to ensure that new recommendations do not violate these business rules. Finally, the casino game operations model data is required to determine for example, which tables are part of the same tier.

Another alternative is to generate all recommendations even if they violate business rules and let the quantification and timing filter remove recommendations that do not have enough projected value or have not had a situation persist for long enough. In this instance recommendations of extremely high value may justify questioning the current business rules.

The betting minimums recommendation generator is an on-demand function and will generate recommendations whenever input is passed to it. The outputs that it provides are recommendations to improve yield management.

A user of this system does not have to interact with this comprehensive data analysis process as it is automated through software.

The Timing Filter 24 determines the amount of time that a situation has persisted relative to a recommendation. This information can be applied towards filtering recommendations from being sent out to a user.

All types of recommendations can be tracked to determine the amount of time this issue has persisted. This can be represented as two lists, where one list contains the set of times, representative of when the entire casino gaming state was taken (see Casino Table Player and Betting Data) sorted chronologically and the other as a list of Boolean values indicating that the situation was present or not. We can determine the length the issue persisted by accumulating the difference between each sample time where the situation was present. For simplicity, this structure shall be named as a recommendation issue time tracker. Note that various other data structures containing this information could be used. By using such a method, we can threshold a recommendation based on the various times the issue appeared without imposing that the situation must have been present for a complete period of time. For example, an occupancy management recommendation could be sent to a user if an occupancy problem has been present for at least 70% of the past 30 minutes. A timing filter is particularly useful for yielding table games because the betting activity and player movements on a casino floor fluctuate constantly and it is not practical for a casino operator to act on brief spikes in occupancy that may occur very often throughout the day. The timing filter helps ensure that only situations that persist are shown to the operator for action.

A recommendation issue time tracker should be initialized based on what the recommendation affects. For example, an HVP recommendation concerns a particular table and thus there should a recommendation issue time tracker for each table in the casino.

The timing filter 24 receives recommendations, the thresholds based on the recommendation type (occupancy thresholds for example), and any information necessary to match a recommendation to its respective recommendation issue time tracker.

The timing filter 24 is an on-demand function and will generate output whenever input is passed to it. The output that it provides is a subset of the recommendations from the input where each recommendation outputted is guaranteed to have met the time based threshold.

Figure 4:
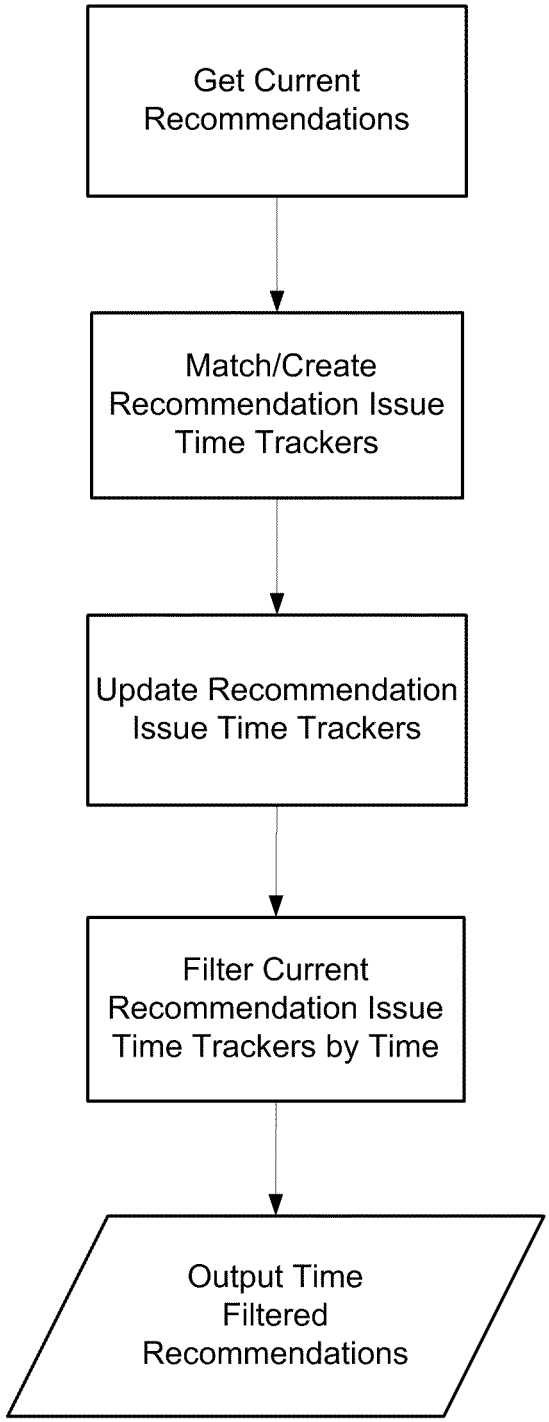
FIG. 4 is a flow chart illustrating the steps involved in the timing filter according to one embodiment.

FIG. 4 shows one embodiment of the timing filter 24. In Get Current Recommendations, the betting minimums recommendation generator 20, inputs the current set of recommendations that it has generated. Match/Create Recommendation Issue Time Trackers determines which recommendation issue time tracker applies to which current recommendation. If a recommendation issue time tracker does not exist for the current recommendation, a new recommendation issue time tracker is created for the current recommendation issue. After this point, every recommendation issue should have a corresponding recommendation issue time tracker. Next, in Update Recommendation Issue Time Trackers, all the issue time trackers currently present are updated by adding the new time which reflects the current time and a Boolean value if the issue was matched in the current recommendations. A Boolean value of true is added for each recommendation issue time tracker that is new or was matched in the current recommendations. A Boolean value of false is added for all other recommendation issue time trackers. Finally, Filter Current Recommendations Issue Time Trackers by Time computes the amount of time that the situation for the current recommendations have persisted for each recommendation issue time tracker. If this time is above the thresholds specified in the business rules, then the recommendation is passed for output, otherwise it is failed and filtered from the output. If any Recommendation Issue Time Tracker has failed consistently for a specified duration of time, then it can be deleted. Finally, the recommendations that pass the filter are output in Output Time Filtered Recommendations.

The Quantification Calculator and Filter 26 determines the projected value of making a recommendation or the value of a recommendation in hindsight as long as the situation persisted and also filter recommendations whose projected value do not meet thresholds defined in the business rules data store. Computing the value for a recommendation is specific to the recommendation type (HVP, occupancy management or business rules). While in FIG. 1, module 26 acts directly on recommendation data, it will be appreciated that module 26 can assess the value of a recommendation using also data from modules 10, 12 and 14. A description of some of the quantification methods are discussed here.

Figure 3:
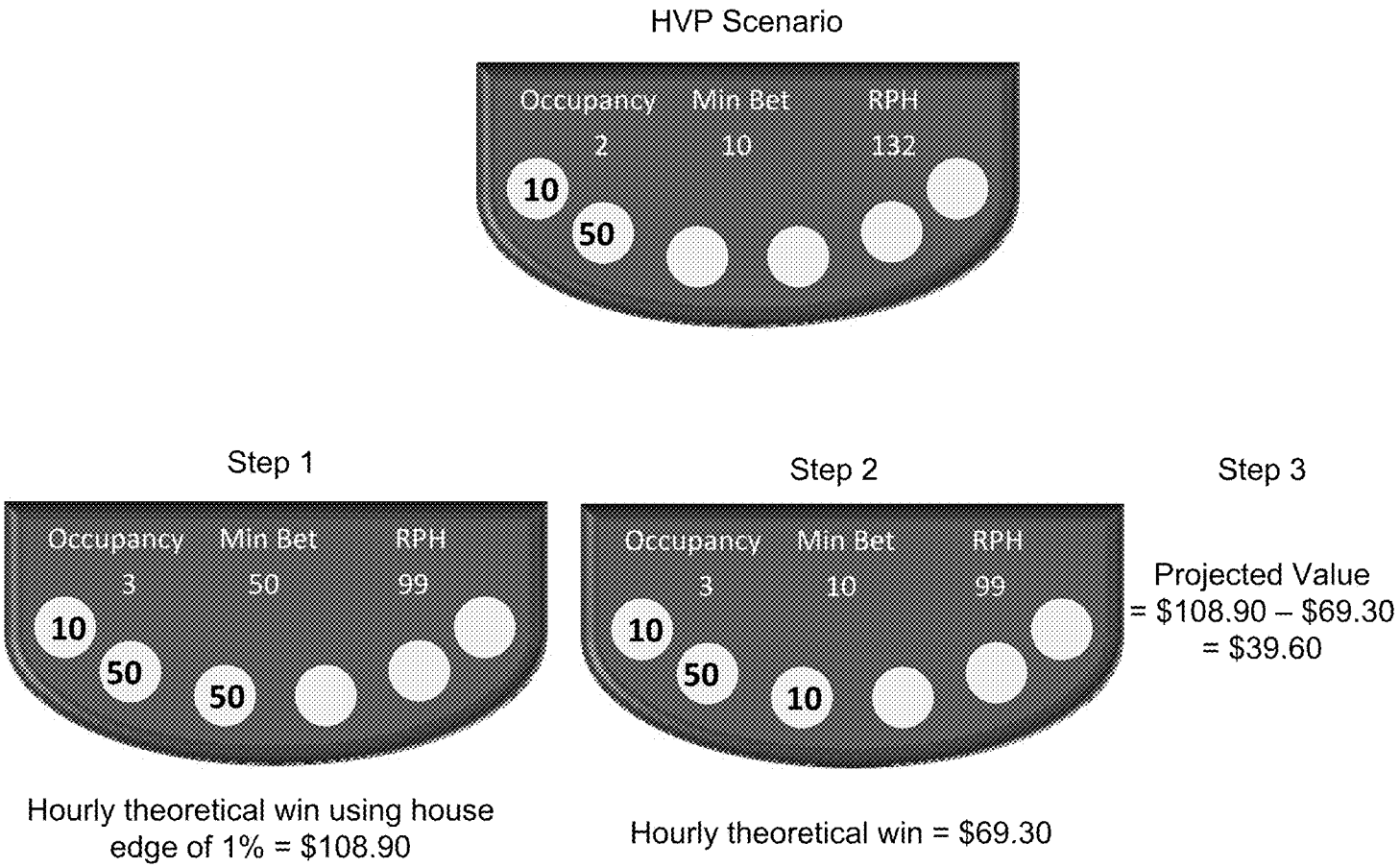
FIG. 3 illustrates calculating a financial value related to increasing a minimum bet at a gaming table under conditions of a high value player presence.

The projected value for a HVP recommendation can be computed as the difference between the theoretical win (see the above description of Casino Game Operations Model Data 14 for a definition of theoretical win) of the current table with an additional player wagering at the recommendations suggested minimum bet (see Step 1 in FIG. 3) and the theoretical win of the current table with an additional player wagering at the current table minimum bet. For example, a $10 table where a $50 HVP has been identified and the suggested table minimum bet change is to raise the table from $10 to $50 (see HVP Scenario in FIG. 3). First, compute the hourly theoretical win of using a house edge of 1% for all players on this table, the rounds per hour (RPH) of 99 based on an arbitrary table game type and occupancy of 3 and also by adding a new player at the new suggested table minimum bet (see Step 1 in FIG. 3). Under these parameters, the theoretical win yields $108.90. Next, compute the theoretical win, using the same parameters, but this time adding a player at the current minimum bet of $10 (see Step 2 in FIG. 3). This yields a theoretical win of $69.30. Finally, the projected value of this recommendation is the difference between the theoretical wins previously computed which amounts to $39.60 (see Step 3 in FIG. 3).

This example assumes that the casino has a grandfathering policy. This allows players to remain on a table wagering at the original table minimum bet even though the table minimum bet has increased. Computing the projected value for a casino that does not allow a grandfathering policy remains the same in principle, but players that are below the new minimum wager must be accounted for and removed in the computation of theoretical win (see step 1 in FIG. 3).

One way of computing the projected value for an occupancy recommendation is by projecting an increase in the current player supply, distributing this new player supply as well as displacing current players that want to move tables. One method to determine an increase in player supply is to use a percentage of the current player supply at that betting tier. The projected value is the difference of the sum of theoretical win computed for all of the tables at the betting tier where new and current players have been added and displaced and the sum of the current casino tables at the same betting tier.

The unrealized value of a HVP recommendation that was not implemented, in hindsight, can be computed historically by reviewing the events that occurred over the period of time where the HVP situation persisted, regardless if a recommendation was present or not. Starting from the beginning of the issue, when the recommendation was first sent out, we analyze the table players and their bets chronologically based on all of the samples that are stored to identify if any of the current set of HVPs are receiving less hands per hour because of new players joining the table at a lower table minimum bet. Once such an event is identified, we track and accumulate the difference in the theoretical win assuming that if the recommendation was implemented these new players could not have joined the table. All table samples are processed chronologically until there are no more HVPs or another HVP recommendation was made.

Similar to the projected value computation, considerations can be taken into account for grandfathering policy, where a player that is grandfathered is allowed to play without penalizing the current set of HVPs.

The unrealized value of an occupancy management recommendation that was not implemented, in hindsight, begins by analyzing the initial state of the casino coinciding with the start of the recommendation and proceeds in a chronological manner to identify all of the players considered part of the recommendation. Based on the assumption that if the recommendation was implemented, these players would have the option to spread out and have a better occupancy experience. To be conservative in computing this value, we only consider players who are at occupancy above the target occupancy level (defined in the business rules) and assume that all players experiencing above target occupancies will now experience target occupancy and thus leading to more rounds per hour for this player and higher theoretical revenue for the casino. We can compute the difference between the theoretical win by changing the rounds per hour in the theoretical win formula for players having occupancy of above target versus target occupancy. For example, if the aggressiveness level is set to moderate, to calculate the unrealized value of an occupancy management recommendation at $25, we calculate the theoretical revenue of all the $25 players who are at high and peak, and the new theoretical revenue if the same players were at optimal occupancy. The unrealized revenue is the difference between the theoretical revenue of the players at optimal occupancy and the players at above optimal occupancy.

To quantify recommendations, first a set of recommendations to be quantified are passed in as input and the information regarding computations of theoretical win from the casino operations model data. Other information considered includes, for all types of recommendations, the data samples representing the casino table players and betting data involved with the recommendation that have been stored for the period of time coinciding with the same time as the situation associated to the recommendation. To filter the recommendations based on projected value, the specified thresholds defined in the business rules are used. As an example, the business rules may specify that only HVP recommendations where the projected value is greater than $10 may be published to the user. As another example, the business rules may specify that only occupancy management recommendations that have persisted for at least 70% of the past 30 minutes may be published to the user.

The quantification calculator and filter 26 is an on-demand function and will generate output whenever input is passed to it. The output that it provides is a subset of the recommendations from the input where each recommendation outputted is guaranteed to have met the projected value threshold as well as the value in hindsight.

The recommendation display unit 30 in the embodiment of FIG. 1 displays the real-time recommendations, after being filtered by the quantification and timing filters, as well as historical recommendations that no longer currently apply. It also displays information regarding open tables, players and their respective wagers and other information regarding the current casino state. The recommendation display unit 30 may use browser-based technology, but any display technology will suffice.

FIG. 5 is an example of a screen shot of the recommendation display unit 30. It shows a graphical representation of gaming tables monitored with their betting minimums and current occupation state. Color coding of labels indicating betting minimum values indicates the recommendation status. Table summaries of the tables by game type is also presented. A text listing of recommendations is also included with a time stamp and status information. It will be appreciated that a screen presentation on a small screen, such as on a palmtop computer may use navigation buttons to switch screen views between the graphical table representation, tables and text listing of recommendations that all can easily fit on a single larger screen.

The display unit uses a network connection to be able to communicate to the recommendation generator, after being filtered by value and time restrictions, the database containing all relevant historical information (recommendations, open tables, players and their wagers, etc.), and the database containing comments made by users relative to the displayed recommendations.

Real-time recommendations can be sent directly to the display unit 30, where the display can be refreshed to show these new recommendations. The display unit can also send recommendations to the historical recommendation database. Alternatively, all recommendations could be stored in a database (new and historical) and the display unit could retrieve any pertinent recommendations the information from this data store. Another alternative is to store all of the display information locally and upon specified time intervals receive all or partial information from all other database via another application responsible for sending the content.

For the display to stay as real-time as possible, the webpage automatically refreshes its content at a specified interval (e.g., 1 minute). The content can also be refreshed upon demand by the users, using standard refresh functionality from the browser.

Prior to a user interacting with this display, a user can log into the system using a name and password. Once the access is granted, the user can interact with this display by clicking on a recommendation and update the status (e.g., accept or reject) or insert a comment relating to the situation, (e.g., "player decided to leave"). Any input received by a user is updated into either the Historical database or the comment editor database where relevant.

The comment editor 32 in the embodiment of FIG. 1 is a simple text editor using browser-based technology that allows a user to add comments through a textbox relative to a specific recommendation. The comment editor 32 can be found via the recommendation display unit 30 by selecting a particular recommendation. In the embodiment of FIG. 1, to access the comment editor 32, a properly working recommendation display unit 30 needs to be present since access to commenting a recommendation is through the display of recommendation on unit 30.

Each comment is associated to a particular recommendation, the time it was submitted, and the user ID or name. This information is stored into a database table. While in the representation of FIG. 1, this database table may be associated either with the editor 32 or the historical log 34, in the representation as illustrated in FIG. 2, this database table can be located on the Yield Management Server. The comment editor 32 functions by displaying any previous comments, displaying the time and the user who entered this comment as well as a simple text box that allows entry of a new comment and a button to confirm adding a comment. Once confirmed, the new comment will be displayed historically and any other user interested in the recommendation will be able to view this comment.

The historical log and dashboard/report generator 34 comprises a database of all information pertaining to the casino state (open or closed tables, players and their wagers) and recommendations that were sent to users. Such information allows reports to be generated and determine the historical yield management effectiveness for a given time period.

The historical log is a database and it functions by saving and retrieving any desired information. The report generator is a view on this data based on a period of time. In the embodiment of FIG. 1, a report is generated through browser-based technology and any machine having access to the network where the system is installed could access these reports.

Any machine having access to the network to communicate the historical log can be used. FIG. 6 illustrates a screen shot of a historical log interface. This interface shows a table of recommendations as a function of time and by category of gaming table. The financial value of recommendations is included in addition to the accepted/rejected status of the recommendations. Statistical overview tables of the number of accepted and rejected recommendations including by the type of recommendation is also shown.

A user does not interact with the historical log directly, but interacts with the report generator by visiting a specific URL. Once at the URL, the user can choose a period of time he wishes to create a report to review. The report is generated dynamically on demand. As mentioned in the above description of the Quantification Calculator and Filter 26, the value of implementing recommendations can also be computed in hindsight and this can be performed using module 34. All recommendations that were generated for the time period can be submitted to this calculator to display the value for each recommendation after the fact.

What is claimed is:

1. A casino table yield management data processing system comprising:

an input module for collecting casino table occupancy and player betting data;

a minimum bet change recommendation generator configured to receive said casino table occupancy and player betting data and generating recommendation data based on casino game operations model data and business rule data, said recommendation data representing a plurality of minimum bet change recommendations;

a timing filter configured to track over time each minimum bet change recommendation contained in said recommendation data, to determine when recommendation data is to be presented to an operator, and to output filtered recommendation data that has been determined to be for operator presentation, said filtered recommendation data representing fewer minimum bet change recommendations than are contained in said recommendation data generated by said recommendation generator; and a display for displaying said filtered recommendation data to an operator.

2. The system as defined in claim 1, wherein said minimum bet change recommendation generator comprises a high value player recommendation generator receiving said casino table occupancy and player betting data to provide player classification data, said high value player recommendation generator using said player classification data to generate recommendation data.

3. The system as defined in claim 1, further comprising a business rule data editor having a user interface for defining a schedule of numbers of gaming tables in operation, and a schedule of conditions concerning numbers of gaming tables offering predetermined betting minimum amounts, said recommendation generator generating recommendations respecting said schedule of conditions.

4. The system as defined in claim 1, wherein said business rule data includes at least one of: schedules of betting minimum possibilities for specific tables;

requirements concerning numbers of gaming tables offering predetermined betting minimum at predetermined time periods; and target occupancies for player betting levels, said recommendation generator generating recommendations respecting said data defining limits.

5. The system as defined in claim 1, wherein said minimum bet change recommendation generator comprises an occupancy recommendation generator evaluating said casino table occupancy and player betting data against said target occupancies of said business rule data to generate recommendation data.

6. The system as defined in claim 1, further comprising a comment editor interface for recording comment data regarding how said recommendation data displayed by said display is evaluated or acted on by a user.

7. The system as defined in claim 6, further comprising a log module recording over time said recommendation data and said comment data.

8. The system as defined in claim 1, further comprising a quantification calculator calculating revenue value data of implementing a minimum bet change in accordance with said recommendation data.

9. The system as defined in claim 8, wherein said revenue value data is compared against a pre-determined threshold in said business rule data to determine if it should be displayed to said operator

10. The system as defined in claim 8, wherein said revenue value data is presented by said display with said recommendation data

11. A casino table yield management data processing system comprising:

an input module for collecting casino table occupancy and player betting data;

a minimum bet change recommendation generator configured to receive said casino table occupancy and player betting data and generating recommendation data based on casino game operations model data and business rule data, said recommendation data representing a plurality of minimum bet change recommendations;

a quantification filter configured to analyze said casino table occupancy and player betting data, and said casino game operations model data and business rule data for each minimum bet change recommendation contained in said recommendation data, to calculate revenue value data of implementing a minimum bet change in accordance with said recommendation data, to determine whether recommendation data is to be presented to an operator as a function of said revenue value data, and to output filtered recommendation data determined to be for operator presentation, said filtered recommendation data representing fewer minimum bet change recommendations than are contained in said recommendation data generated by said recommendation generator;

a display for displaying said filtered recommendation data to an operator.

12. The system as defined in claim 11, wherein said revenue value data is compared to a threshold in said business rule data in order to determine if said recommendation data is suitable to be displayed on said display to said operator.

13. The system as defined in claim 11, wherein said minimum bet change recommendation generator comprises a high value player recommendation generator receiving said casino table occupancy and player betting data to provide player classification data, said high value player recommendation generator using said player classification data to generate recommendation data.

14. The system as defined in claim 11, further comprising a business rule data editor having a user interface for defining a schedule of numbers of gaming tables in operation, and a schedule of conditions concerning numbers of gaming tables offering predetermined betting minimum amounts, said recommendation generator generating recommendations respecting said schedule of conditions.

15. The system as defined in claim 11, wherein said business rule data includes at least one of: schedules of betting minimum possibilities for specific tables;

requirements concerning numbers of gaming tables offering predetermined betting minimum at predetermined time periods; and target occupancies for player betting levels, said recommendation generator generating recommendations respecting said data defining limits.

16. The system as defined in claim 11, wherein said minimum bet change recommendation generator comprises an occupancy recommendation generator evaluating said casino table occupancy and player betting data against said target occupancies of said business rule data to generate recommendation data.

17. The system as defined in claim 11, further comprising a comment editor interface for recording comment data regarding how said recommendation data displayed by said display is evaluated or acted on by a user.

18. The system as defined in claim 17, further comprising a log module recording over time said recommendation data and said comment data.

* * * * *